United States Patent [19]

Hudelmaier

[11] Patent Number: 4,522,499

[45] Date of Patent: Jun. 11, 1985

[54] CONCRETE MIXER

[75] Inventor: Gerhard Hudelmaier, Ulm, Fed. Rep. of Germany

[73] Assignee: Ingrid Hudelmaier, Ulm, Fed. Rep. of Germany

[21] Appl. No.: 517,763

[22] Filed: Jul. 27, 1983

[30] Foreign Application Priority Data

Aug. 3, 1982 [DE] Fed. Rep. of Germany ..... 3228983

[51] Int. Cl.[3] ..... B01F 9/08

[52] U.S. Cl. ..... 366/56; 366/59; 366/224; 366/228; 366/332

[58] Field of Search ..... 366/53, 54, 56, 57, 366/59, 64, 66, 224, 227, 228, 276, 277, 279, 299, 314, 332; 277/212 FB

[56] References Cited

U.S. PATENT DOCUMENTS 1,196,612 8/1916 Taylor ..... 366/276
3,807,195 4/1974 Faulbecker ..... 277/212 FB
3,933,341 1/1976 Hudelmaier ..... 366/57
3,945,311 3/1976 Gasbarro ..... 366/332

*Primary Examiner*—Robert W. Jenkins
*Assistant Examiner*—Arthur D. Dahlberg
*Attorney, Agent, or Firm*—James E. Nilles

[57] ABSTRACT

The invention relates to a concrete mixer, particularly to a truck-mounted concrete mixer, comprising a drum and an actuatable additional mixer tool projecting into the drum from the bottom thereof substantially in the direction of the drum axis. A rotatably driven mixer tool of this type requires the employ of additional gearing, and a sealing assembly for the passage of its shaft through the drum bottom is very complicated and subjected to wear. In accordance with the invention, these disadvantages are avoided by the provision that the mixer tool is adapted to be moved in the axial direction. This permits a cylinder-piston unit to be employed as the drive source for the mixer tool. No gearing is required, and sealing as well as maintenance are simplified.

3 Claims, 2 Drawing Figures

CONCRETE MIXER

Figure 1:
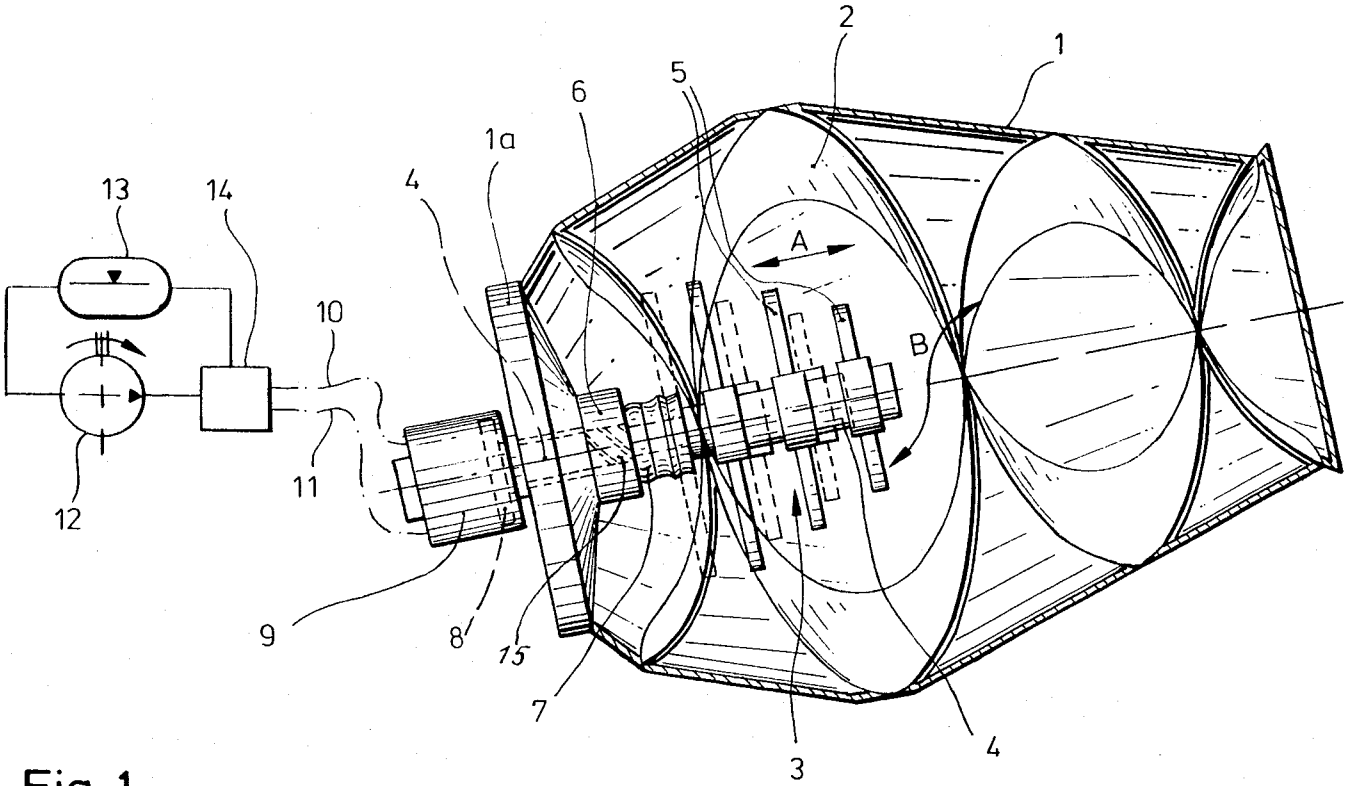

The present invention relates to improvements in concrete mixers of the type comprising a mixing drum which is open at one end and which normally rotates on an axis that is inclined upwardly and towards that open end, and wherein agitating elements are fixed to the interior surface of the drum for mixing concrete as the drum rotates; and the invention is more particularly concerned with auxiliary mixing means operating inside the drum of such a mixer whereby mixing efficiency is increased.

A concrete mixer of this type is known from West German Pat. No. 29 19 826. It comprises a mixing drum provided with helical mixer elements fixedly attached to its interior wall surface.

An additional mixer tool in the form of a shaft projecting into the interior of the mixing drum and carrying a plurality of paddle rings is rotatably mounted in the interior of the drum. The mixer tool shaft extends coaxially through a hollow stub axle secured to a bottom end wall of the drum. The mixer tool, i.e. its shaft, is adapted to be driven by the drive motor of the mixing drum through an additional reduction gear assembly. It is also known to provide a clutch between the drive source for the drum and the gear assembly for the mixer tool, so that the former may be driven independently of the latter, or so that the mixer tool can be started to rotate after the drum has been rotating for some time, respectively.

In the known mixing drum, the through-opening provided in the drum bottom for the passage of the mixer tool shaft has to be sealed in a rather complicated manner due to the rotary movement of the shaft. Moreover, the indispensable gear assembly and the rotary mounting of the shaft give rise to additional wear phenomena, and the supplementary gear assembly increases the overall weight.

It is an object of the present invention to provide a concrete mixer as defined in the introduction, wherein the additional mixer tool may be installed and actuated in a simple and economical manner.

It has been unexpectedly found that an axially reciprocating mixer tool is able to promote the mixing process within the drum as effectively as a rotatably driven mixer tool. The axial movement of the tool can be generated in a simple manner and at any desired frequency without the need for expensive additional gearing. A considerable advantage is to be seen in the fact that a longitudinally displaceable shaft can be sealingly mounted in the drum bottom in a particularly simple manner. Maintenace operations are likewise simplified as compared to a rotary drive system.

A simple embodiment of the actuating means for the mixer tool is one wherein the mixer tool is actuated by a cylinder and piston unit, and the mixer tool can comprise a part of that unit. A preferred embodiment having guide means for imposing a rotary movement on the mixing tool as a concomitant of its axial displacement results in a particularly effective mixing process due to an additional relative movement between the mixer tool and the material to be mixed. In this embodiment, the mixer tool and the mixer elements carried thereby may perform an oscillating rotary movement, i.e. axial displacement in one direction may result in rotary movement to the right, while displacement in the opposite axial direction results in rotary movement to the left.

Control means can be provided whereby irregular movements are imposed on the mixer tool so as to avoid the occurrence of resonance phenomena in the material to be mixed.

Figure 2:
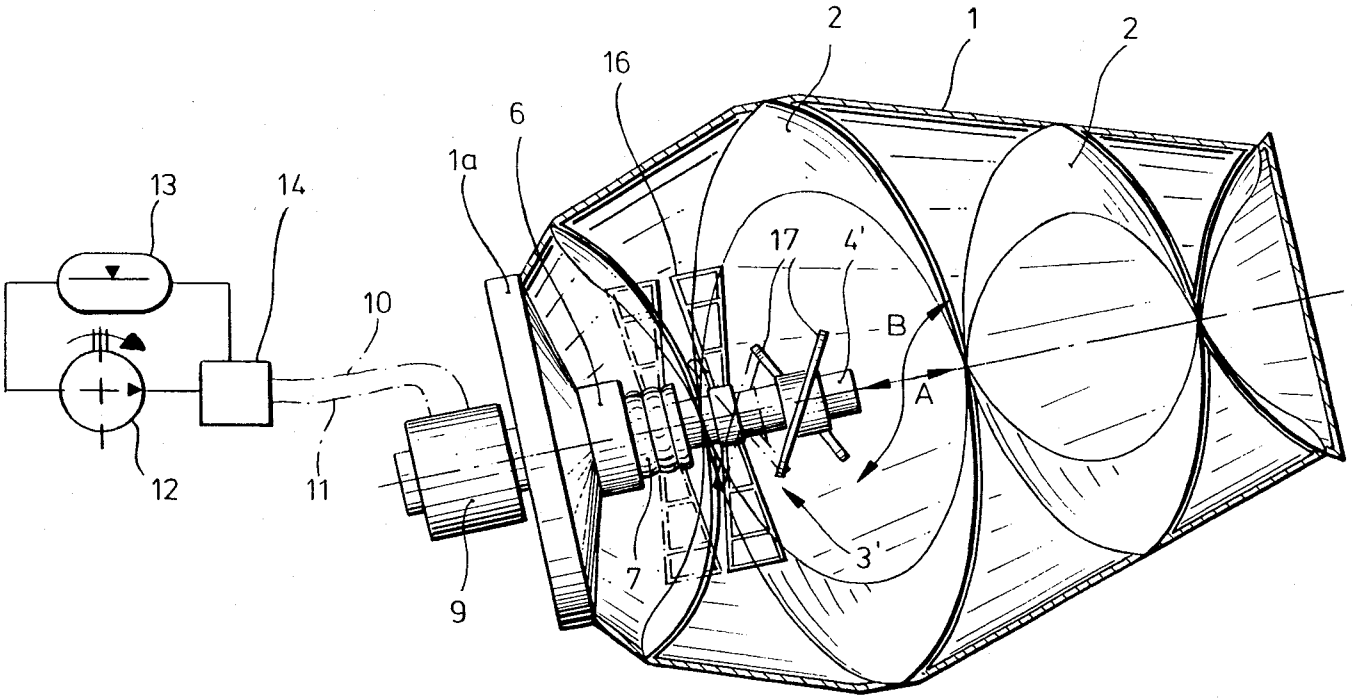

Embodiments of the invention shall now be described with reference to the accompanying drawings, wherein:

FIG. 1 shows a diagrammatic sectional view of a concrete mixer drum with an additional mixer tool, and FIG. 2 shows a cross-sectional view of a modified embodiment of a drum of this type.

A drum 1 for mixing concrete as shown in FIG. 1 may be mounted on a stationary frame, but is preferably mounted on a vehicle so as to provide a concrete mixer truck. The mounting of the drum as well as the drive system therefor and other accessories are not particularly shown in the drawings for the sake of clarity. These components may be of any known construction. Drum 1 is provided with helical mixer elements 2 at its interior wall surface. Extending into the interior of drum 1 from the drum bottom 1*a* is an additional mixer tool generally designated 3. It consists essentially of a shaft 4 and a plurality of arms 5 attached thereto. Arms 5 are attached to shaft 4 in pairs so as to extend perpendicularly thereto, the length of arms 5 increasing from the free end of shaft 4 towards the drum bottom 1*a*. Shaft 4 extends through drum bottom 1*a* and a hub portion 6 thereof, and is surrounded by a resilient sleeve 7 attached to hub portion 6 so as to project towards the interior of drum 1. Sleeve 7 serves for sealing the passage of shaft 4 through drum bottom 1*a*. Thanks to its resiliency, sleeve 7 is enabled to follow the axial movements of shaft 4.

Exteriorly of drum 1 shaft 4 ends in the form of a disk-shaped piston 8 guided in a cylinder 9. Connected to cylinder 9 are two conduits 10 and 11 of a hydraulic system including a hydraulic pump 12, a pressure accumulator 13, and a control unit 14. Conduits 10 and 11 act alternately as pressure and return lines. The control unit, formed for instance as a controlled valve or a flow divider, is effective to impose irregular movements on the mixer tool.

Independently of a rotary movement of drum 1, the hydraulic system may be actuated at any time for imposing axial movements in the direction of arrow A on mixer tool 3. The two end positions of this axial movement of arms 5 are shown in the drawings by full lines and phantom lines, respectively. The illustrated position of disk-shaped piston 8 corresponds to the position of arms 5 shown in full lines. A second position of the piston 8 has not been shown in the drawings for the sake of clarity.

In addition to the axial displacement in the direction of arrow A, a rotary movement in the direction of arrow B is imposed on mixer tool 3. This is accomplished by means of helical guide means 15 disposed in hub portion 6 and diagrammatically indicated in FIG. 1. In cooperation with a projection on shaft 4, helical guide means 15 cause shaft 4 and thus arms 5 to perform a clockwise rotary movement, as seen from the mouth of drum 1, during the axial movement of mixer tool 3 into the drum, and a counterclockwise movement during the axial return movement. This results in an additional mixing effect.

FIG. 2 shows a concrete mixer in a representation alalogous to that of FIG. 1. The only difference is in the configuration of the mixer tool to be described in detail. The remaining parts are designated by the same reference numerals as in FIG. 1.

The mixer tool comprises a shaft 4' carrying mixer elements in the form of blades 16 attached to shaft 4' in spaced relation to the free end thereof. Attached to shaft 4' adjacent its free end are paddles 17 extending in planes inclined with respect to the longitudinal direction of shaft 4'. Analogous to the illustration in FIG. 1, blades 16 and paddles 17 are shown in two different axial positions relative to drum 1. The concrete mixer of FIG. 2 is likewise provided, although not shown in detail, with positive guide means for imposing an oscillatory rotary movement on shaft 4' in the direction of arrow B.

The invention is not restricted to the exemplary embodiments shown and described. The essential characteristic is the basically axial movement of the mixer tool. The tool itself as well as the mixer elements attached thereto, its mounting arrangement and the axial actuating system associated therewith may be modified within a wide range. The mixer tool may perform a simple axial movement without additional rotary movements. It is also possible, however, to provide an embodiment in which the positive guide means is effective to cause a continuous rotary movement of the mixer tool, as for instance in the case of a screw drill, instead of an oscillating rotary movement.

A mixer tool according to the invention, particularly when provided with a positive guide means for producing rotary movement, may also be employed in a stationary drum.

I claim:

1. In combination with a concrete mixing drum having a side wall that tapers coaxially from a medial largest diameter portion to an upper end of the drum that is open for filling and discharge and to a bottom end of the drum that is closed by an end wall, said drum having an axis about which it is rotatable and normally having said axis inclined to the horizontal so that said upper end is higher than said bottom end, and agitating means fixed to said side wall in the interior of the drum and extending along a substantial portion of the length of the drum, for imparting mixing agitation to contents of the drum as it rotates:

A. A mixing tool for cooperation with said agitating means to effect thorough mixing of drum contents, comprising (1) an elongated shaft which coaxially extends lengthwise slidably and relatively rotatably through said end wall and (2) substantially radially projecting mixer elements secured to said shaft in the interior of the drum, in axially spaced relation to said end wall;

B. reciprocating actuating means at the exterior of the drum connected with said shaft for lengthwise reciprocating said mixing tool; and C. cooperating means on said end wall and on said shaft for imparting rotation to said shaft in consequence of lengthwise movement thereof.

2. The combination of claim 1, further characterized by:

C. a supple sleeve surrounding a portion of said shaft in the interior of the drum and having sealing connections at its opposite ends, to said shaft and to said end wall, respectively, to seal off from contents of the drum the portion of said shaft that slides in said end wall.

3. The combination of claim 1 wherein said actuating means comprises:

(1) a piston fixed to the end of said shaft which is at the exterior of said drum, (2) a cylinder mounted coaxially with the drum at the exterior thereof and adjacent to said end wall, wherein said piston is slidable, and (3) means for supplying pressure fluid to said cylinder, alternately at opposite sides of said piston.

* * * * *